United States Patent [19]

Good

[11] Patent Number: 4,732,528

[45] Date of Patent: Mar. 22, 1988

[54] RETURNABLE SKID AND METHOD AND ASSEMBLY USING SAME

[75] Inventor: Bruce R. Good, Plantsville, Conn.

[73] Assignee: Cold Metal Products Corp., Youngstown, Ohio

[21] Appl. No.: 918,055

[22] Filed: Oct. 14, 1986

[51] Int. Cl.[4] ..... B65D 19/06

[52] U.S. Cl. ..... 414/786; 414/110; 414/911; 414/608; 206/389; 206/600; 206/821; 108/53.1; 108/55.1; 410/48; 410/49

[58] Field of Search ..... 414/786, 110, 911; 206/389, 600, 386, 595, 598, 391, 394, 53, 407; 108/53.1, 53.5, 55.1, 55.5, 56.1, 55.3, 901; 410/47, 48, 49

[56] References Cited

U.S. PATENT DOCUMENTS

| | | | |
|---|---|---|---|
| 1,957,153 | 5/1934 | Smiley, Jr. | 206/821 X |
| 2,262,794 | 11/1941 | Burbank . | |
| 2,448,447 | 8/1948 | Lau . | |
| 2,664,219 | 12/1953 | Schmidt . | |
| 2,803,363 | 8/1957 | Hutchinson | 414/608 |
| 2,971,768 | 2/1961 | Ackley et al. | 108/55.3 X |
| 3,050,184 | 8/1962 | Post | 206/53 |
| 3,157,423 | 11/1964 | Brie, Sr. | 108/51.1 X |
| 3,247,558 | 4/1966 | Kaufman | 206/53 X |
| 3,285,204 | 11/1966 | Schweitzer . | |
| 3,315,800 | 4/1967 | Wagner . | |
| 3,375,793 | 4/1968 | Wagner . | |
| 3,521,764 | 7/1970 | Loomis | 108/53.1 X |
| 3,626,872 | 12/1971 | Cully | 108/55.1 |
| 3,753,407 | 8/1973 | Tilseth . | |
| 3,844,600 | 10/1974 | Jay . | |
| 3,858,723 | 1/1975 | Weiss . | |
| 4,240,773 | 12/1980 | Terry | 414/911 X |
| 4,257,523 | 3/1981 | Blasio . | |
| 4,344,368 | 8/1982 | Remington . | |
| 4,596,506 | 6/1986 | Burgardt et al. | 410/49 X |
| 4,690,605 | 9/1987 | Coccaro | 414/911 X |

FOREIGN PATENT DOCUMENTS

| | | | |
|---|---|---|---|
| 692071 | 8/1964 | Canada | 108/55 A |
| 728424 | 4/1955 | United Kingdom | 108/53 B |
| 1017605 | 5/1983 | U.S.S.R. | 206/598 |

*Primary Examiner*—Robert J. Spar
*Assistant Examiner*—Vien Nguyen

[57] ABSTRACT

A returnable skid for coiled products employs separator posts that are storable within other components. The same assembly that mounts the posts during use also cooperates with the corresponding assembly of a like skid to interengage them in stacked condition. Both of these features facilitate transport of the empty skids. The construction provided minimizes the amount of extraneous packaging materials that are required to maintain the coils of product in place on the skid and to properly protect them, and the coils can be disposed either standing upright or lying flat on the skid.

17 Claims, 11 Drawing Figures

RETURNABLE SKID AND METHOD AND ASSEMBLY USING SAME

BACKGROUND OF THE INVENTION

Coils of product, such as oscillated wound steel coils, are normally shipped on rectangular skids. Generally, each skid holds two coils in upright side-by-side positions, the skid being constructed to provide recessed areas in which the coils may be seated on edge; they are usually strapped in place using steel banding or the like. It is also important that the skid be able to accommodate a single coil lying flat, since a shipment frequently consists of an odd number of coils.

In addition to maintaining the coils in position, the skid must have means to keep them out of contact with one another so as to avoid damaging the product, the edges of which are particularly vulnerable. This may be done by using separator members in addition to the banding by which the coils are strapped in place, such separator members generally comprising hefty structural pieces interposed between the two side-by-side coils.

As a matter of economy, skids used for this purpose must be capable of repeated use, and must therefore be well adapted for transport in bulk for return to the manufacturer or distributor of the product. Normally, the empty skids will be stacked one upon another to achieve maximum utilization of the space available in the truck or freight car used for transporting them, and they must therefore be constructed with this in mind.

The skids heretofore provided for holding coils of product have not adequately satisfied all of these criteria. Moreover, in certain instances they have necessitated the use of excessive amounts of packaging materials, they have been overly massive and heavy, and they have not been well suited to use for coils of a range of diameters. In addition, for most facile handling it is very desirable that skids of this kind accommodate the fork of a fork-lift truck from each of four directions, and that they be capable of rolling on a conventional conveyor in either a sidewise or endwise orientation.

Accordingly, it is an object of the present invention to provide a novel skid for holding coiled products, which is adapted to securely maintain them in either upright or flat positions, which will effectively maintain side-by-side coils out of contact with one another, and which will provide a high degree of protection to the product.

It is also an object of the invention to provide such a skid which does not require the use of packaging components other than banding to maintain the coils of product in place, which is capable of holding coils of differing sizes, and which is relatively light in weight for easy handling and yet sufficiently strong and durable to permit repeated use.

Another object is to provide a novel skid having separator posts that can be disassembled and stored within components on the base for convenient return shipment, and that may also have interengaging components to enhance the security of stacking with another skid of like construction.

Yet another object is to provide a skid that can be lifted from either the end or the side, and can be conveyed either sidewise or endwise.

A still further object of the invention is to provide a novel method for the loading, unloading and return of a skid for coiled products.

SUMMARY OF THE DISCLOSURE

It has now been found that certain of the foregoing and related objects of the invention are readily attained by the provision of a returnable skid comprised of a frame-like, generally rectangular base with a substantially flat bottom surface; a pair of upstanding side supports extending transversely along the opposite lateral margins of the base; and a pair of substantially hollow, generally rectilinear end supports extending laterally across the side supports adjacent the opposite ends of the base and thereabove to define, in cooperation with the side supports, an upwardly opening recess for receiving edge portions of coils of products seated on the skid. The skid also includes a pair of generally rectilinear separator posts dimensioned and configured to fit individually within the cavities of the end supports, and end supports being open at least at one end to permit insertion of one of the posts thereinto; means for disengageably mounting one of the posts in an upstanding attitude adjacent the opposite ends of the base and between the side supports; and means for disengageably securing the posts within the end support cavities. Thus, the posts may be supported by the mounting means to extend between two coils seated vertically on the skid, or they may be stored within the cavities of the end supports when not in use.

Normally, the skid will additionally include a center support extending transversely of the base between the side supports and having opposite ends adjacent the opposite ends of the base, the mounting means for the posts beng disposed on the opposite ends of the center support. In the preferred embodiments, the end supports will comprise tubular members, and the side supports will be provided with apertures in which the tubular members are engaged. The side supports may have portions overlying and closing one end of each of the tubular members, with the securing means being disposed on the other of the side supports and being displaceable between positions for securing the posts within the cavities, and for permitting insertion thereinto and withdrawal therefrom. The securing means may, more specifically, comprise a pair of latches, each latch having an element that is selectively positionable across the open end of the associated tubular member.

Most desirably, the side supports and the end supports all have top surfaces lying in a common plane. They will usually have elements thereon providing the top surfaces, which elements will suitably be fabricated from a relatively hard and durable synthetic resinous material.

In especially preferred embodiments, the mounting means for the separator member will comprise an assembly adjacent each of the opposite ends of the base. Each such assembly will include a fixed, downwardly extending element having a lower end disposed at a level short of the plane of the bottom surface of the base, and a resiliently supported, upwardly extending element having an upper end biased to a normal position elevated above the plane in which the uppermost of the top surfaces of the side and end supports are disposed. The upwardly extending element will be displaceable to position its upper end at a level on or below the top plane, and both elements will be configured for interengagement so as to adapt the skid for interengaged stacking with a skid of like construction. The upwardly extending element will also be adapted for mounting of the separator member, and the skid can be used to support a coil of product lying horizontally on the uppermost top surfaces, with the upwardly extending elements displaced downwardly, as necessary.

The mounting assemblies may, more particularly, comprise a normally vertically oriented sleeve, a protuberance attached to the lower end of the sleeve and providing the downwardly extending element, a coupling piece slidably mounted by the sleeve for movement along the axis thereof and providing the upwardly extending element, and means biasing the coupling piece toward the elevated position of the upper end. The coupling piece will be adapted to interengage with both the protuberance and also an end portion of the separator member, and it may be a collar having a cavity extending inwardly from the upper end thereof along the axis of the sleeve. The protuberance of the mounting assembly and the end portion of the separator member will both be configured to fit within the cavity of the collar.

In certain embodiments, a separator post will be used which has a cavity extending inwardly from one end thereof, and which includes a clamping fixture disposed therewithin. The fixture will be adapted to receive and retain a piece of the product of which the coil seated on the skid is comprised, and it may consist of a pair of resiliently deflectable legs having outer end portions disposed at the entrance to the cavity of the post and normally in contact with one another. The legs will be adapted to frictionally engage a piece of product inserted between time.

Additional objects are attained by the provision of a method utilizing the above-described skid. The method includes the steps of: loading two coils of product on the skid in side-dy-side, laterally spaced positions with edge portions of the coils received within the upwardly opening recess of the skid; strapping the coils to the skid; engaging the separator posts in the mounting means in an upstanding attitude adjacent the opposite ends of the base to extend between the coils; transporting the skid with the coils loaded thereon; unstrapping the coils and unloading them from the skid; disengaging the posts from the mounting means; inserting the posts into the cavities of the end supports, and securing them therewithin; and transporting the unloaded skid with the posts so stored.

In preferred embodiments, the method will additionally include the step, effected prior to the step of transporting the unloaded skid, of superimposing the skid upon a second, like skid, and interengaging the downwardly extending elements of the assemblies of the upper skid with the upwardly extending elements of the assemblies of the second skid disposed beneath it.

DETAILED DESCRIPTION OF THE ILLUSTRATED EMBODIMENT

Figure 1:
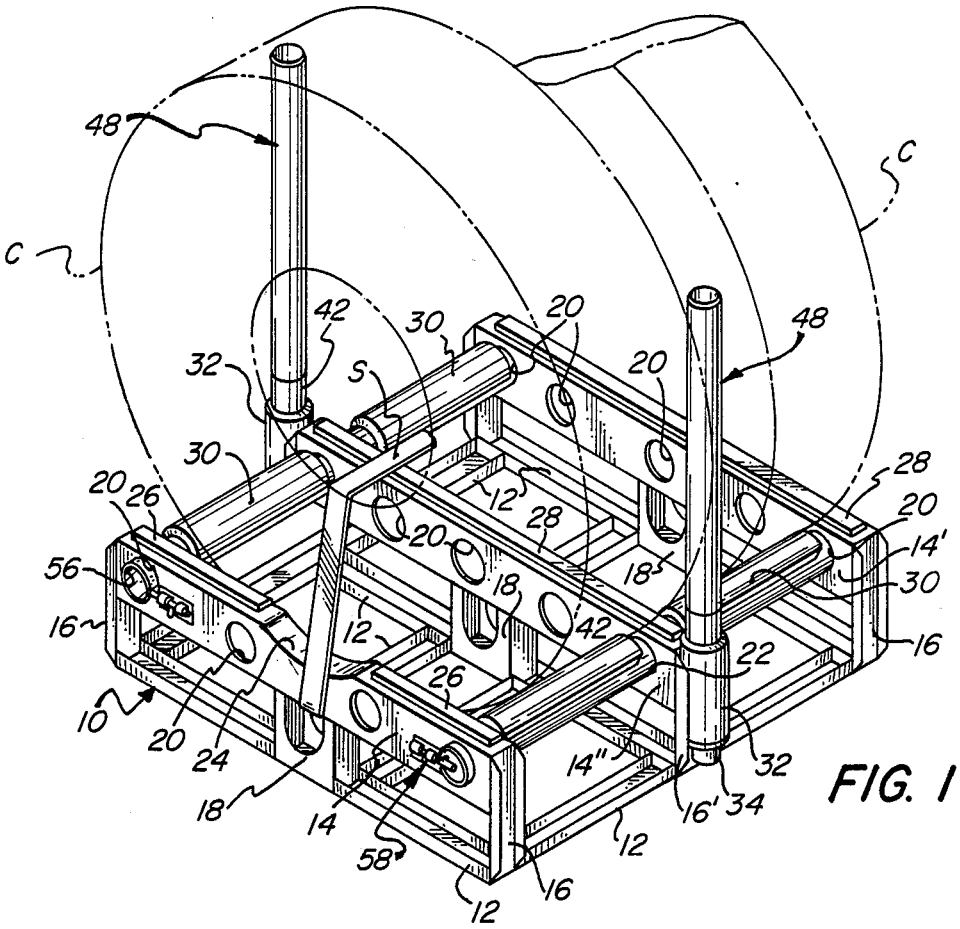
FIG. 1 is a perspective view of a returnable skid embodying the present invention, showing in phantom line a pair of coils of product seated in upstanding vertical position thereupon.

Turning now in detail to the appended drawings, therein illustrated is a returnable skid embodying the present invention, comprised of a frame-like base, generally designated by the numeral 10, fabricated from a number of welded pieces 12 of bar channel, of various appropriate lengths. A pair of side supports 14, 14', of box-like tubular construction, extend transversely along the lateral margins of the base 10, and are supported by upright corner pieces 16 of bar channel; U-shaped props 18, joined to the pieces 12, underlie the central portions of the side supports 14, 14'. A central support 14'' extends parallel to the side supports 14, 14' and midway therebetween, and is supported by upright channel piece 16' and a central prop 18. As will be appreciated, the bar channel pieces 12 cooperate to define a flat bottom surface on the base of the skid which is sufficiently continuous to permit transport of the skid on a conventional roller conveyor, regardless of whether it is aligned on, or transverse to, the conveyor axis.

Figure 3:
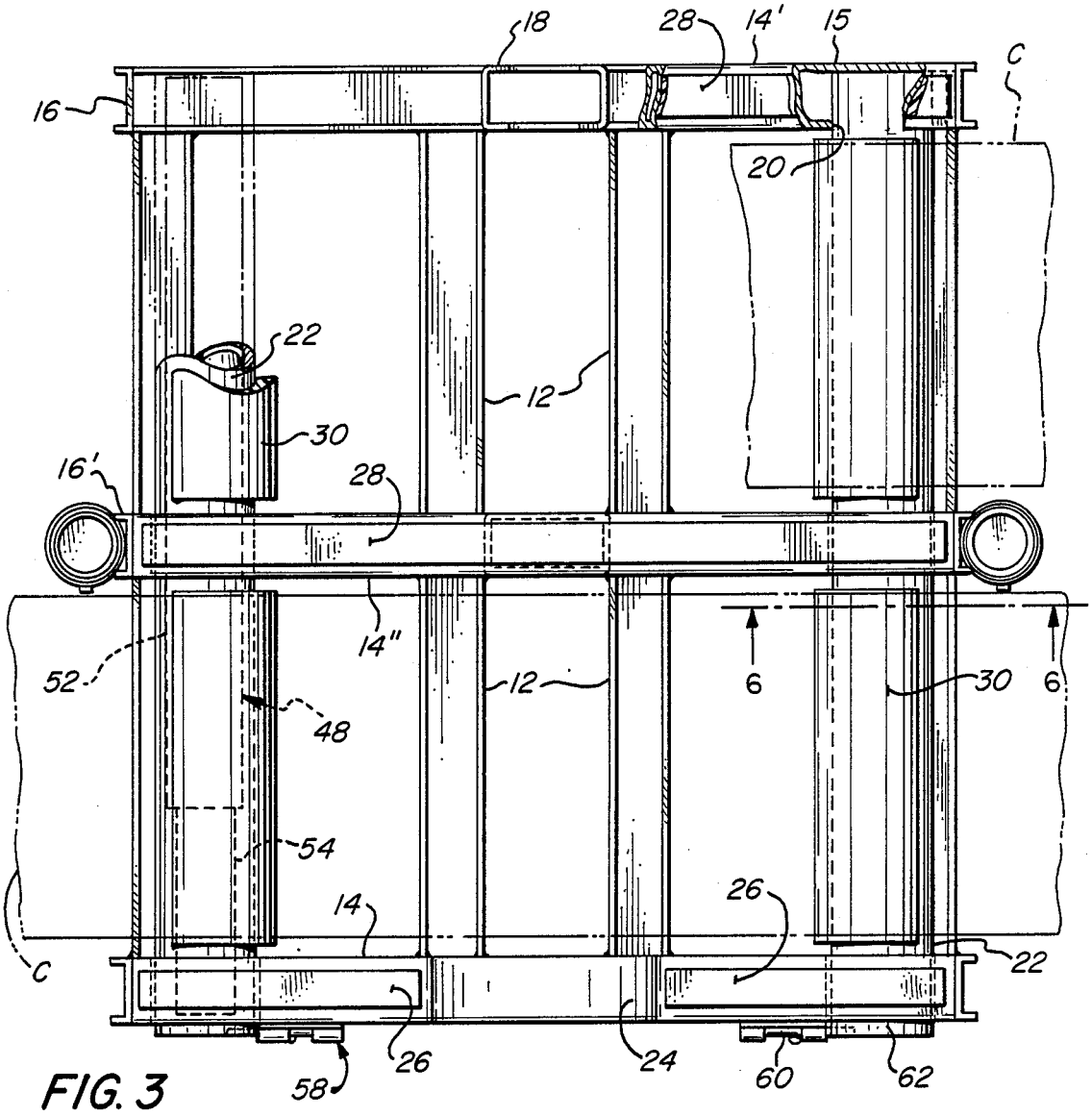
FIG. 3 is a fragmentary plan view of the skid and seated coils of FIG. 1.
Figure 4:
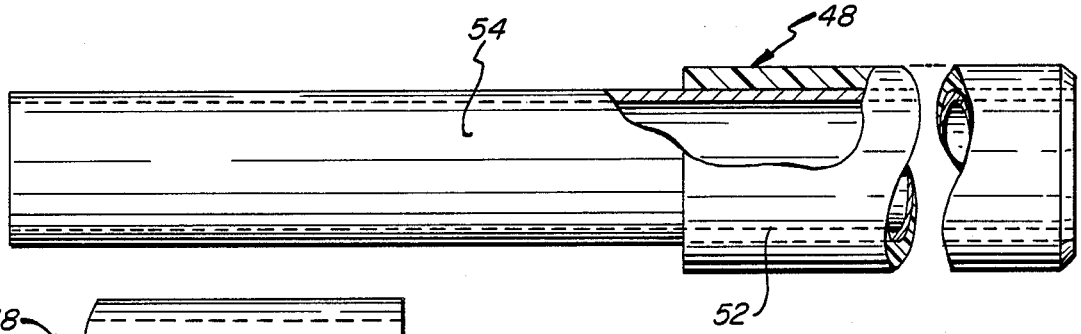
FIG. 4 is a fragmentary elevational view of one of the separator posts utilized in the skid of the foregoing figures, with portions broken away to show internal structure.
Figure 11:
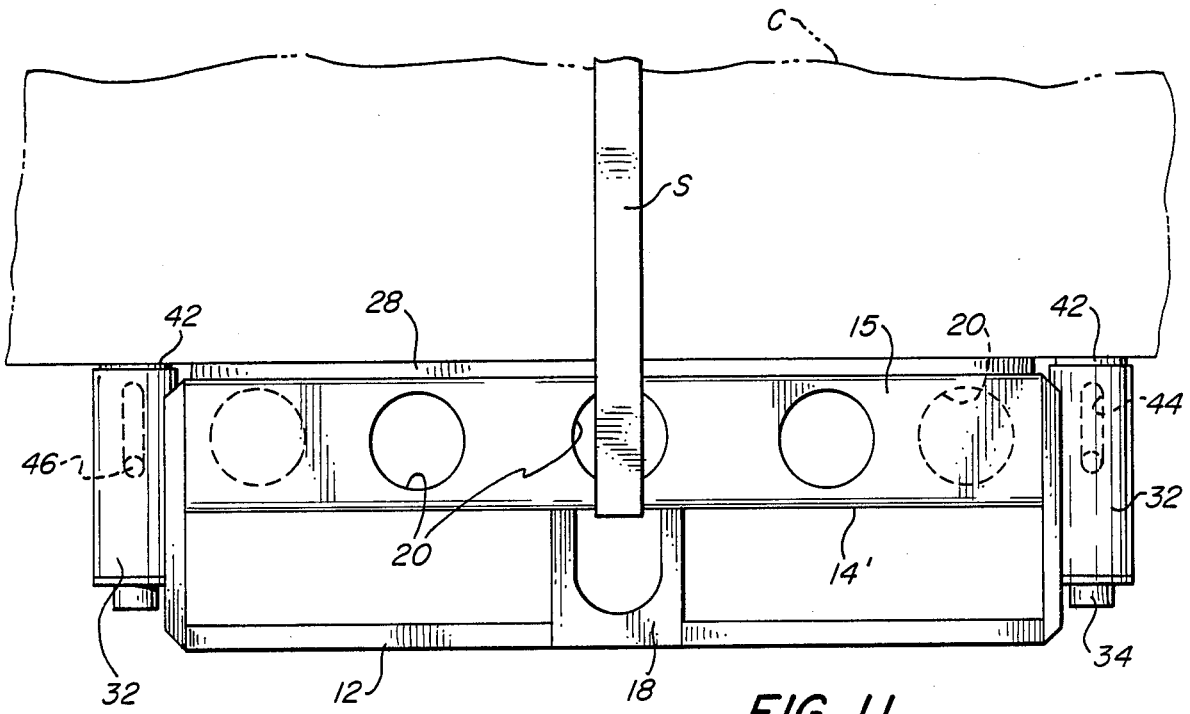
FIG. 11 is a elevational view similar to FIG. 2 but taken from the opposite side of the skid, showing a coil of product seated horizontally thereon.

The sidewalls of the three supports 14, 14', 14'' are provided with circular apertures 20, the end-most ones of which serve to receive and engage cylindrical end supports 22, the inboard ones (like the U-shaped cutout of the props 18) being provided for weight-reduction purposes as well as to provide openings for the receipt of securing bands. As can be seen in FIGS. 3 and 11, the outer wall 15 of the side support 14' has no aperture aligned with the end-most apertures formed through the inner wall thereof, for a reason that will be discussed hereinbelow. In addition, it will be noted that the side support 14 is formed with an arcuate depression 24 in its upper edge, the function of which will also be discussed.

Strips of protective material 26, 28 are secured (by adhesive bonding, or by the use of mechanical fasteners) on the upper edge surface of the side supports 14, 14'; generally, they will be fabricated from a relatively hard and durable material, such as hard rubber, phenolic resin or the like, typically having a Durometer value of about 80, and they provide both physical and chemical protection to prevent damage and corrosion of the coiled product that is transported on the skid. Similar strips 30 of arcuate cross-section are secured on the surfaces of the cylindrical end supports 22 and, as can best be seen in FIGS. 2 and 6, the uppermost surfaces of the strips 26, 28, 30 lie in a common plane.

The central upright channel pieces 16' at the opposite ends of the skid have cylindrical sleeves 32 affixed to them at an orientation that will normally be vertical. A smaller diameter cylindrical protuberence, or nipple, 34 extends downwardly from the sleeve 32 and is joined thereto by an annular piece, which may be provided as a flat washer 36. A short cylindrical spacer 38 is positioned upon the washer 36 at the lower end of and within the sleeve 32, against which bears the lower end of a coil spring 40. A cylindrical collar 42 is telescopically mounted for sliding movement within the sleeve 32, and it rests upon the opposite end of the coil spring 40 and is biased in an upward direction thereby. The sleeve 32 has an axially extending slot 44 formed through it, in which is engaged the head of a screw 46, which is fixed within an aperture provided in the collar 42. In this manner the collar is held in assembly with the sleeve, for limited axial movement.

In normal use of the skid, a separator or spacer post, generally designated by the numeral 48, is vertically supported by the mounting assembly at each end of the base 10. As illustrated, the post 48 will normally consist of a pipe 50 or other cylindrical metal piece, having a plastic sleeve 52 covering ti over most of tis length. The lower end portion 54 of the pipe is free of the covering sleeve, and is inserted downwardly through the passageway 43 of the collar 42 and into the housing 32 of the mounting assembly. The lower edge of the sleeve 52 is disposed in contact with the upper edge of the collar 42.

Figure 2:
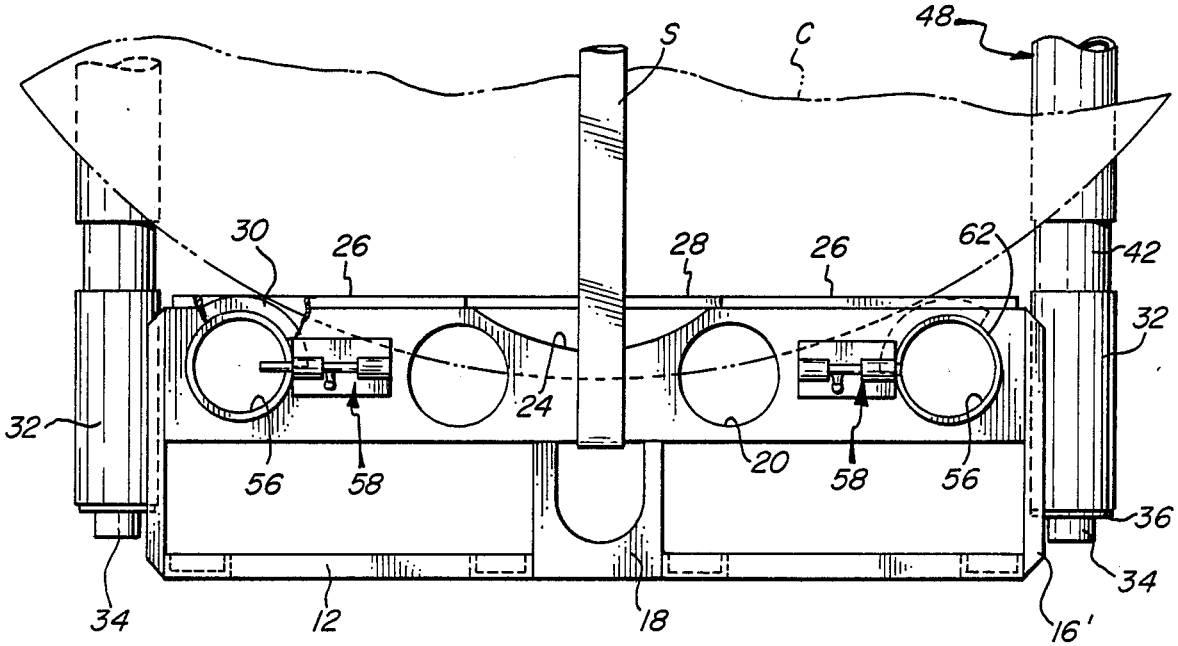
FIG. 2 is a fragmentary side elevational view of the skid of FIG. 1, drawn to an enlarged scale.

As illustrated by FIGS. 1-3, the skid of the invention may be used to support a pair of coils "C" in a side-by-side relationship, the edges of the coils resting upon the arcuate strips 30 of the end supports 22 and extending into the recesses defined by the supports 14, 14', 14'', 30. The two posts 48 extend upwardly between the coils C to prevent them from contacting one another; they also maintain separation to permit introduction of a sling therebetween for unloading purposes. Each coil C is held in place on the skid by a suitable strap, or metal band, "S", and it will be appreciated that other or supplemental banding arrangements may be used; for example, a strap may be disposed circumferentially about each coil and the associated end supports 22, the two coils may be strapped together about the separator posts 48, etc.

Figure 5:
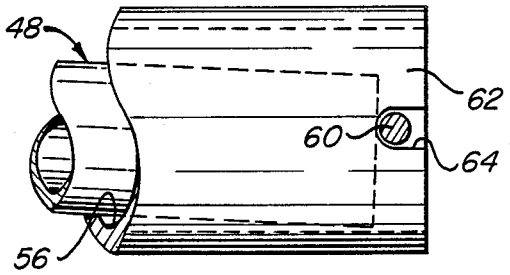
FIG. 5 is a fragmentary view showing an end portion of one of the tubular end supports utilized in the skid, with one of the separator posts contained therewithin.

When the separator posts 48 are not in use, such as during transport of the unloaded skids, they are conveniently stored within the end supports 22. It is simply a matter of inserting them axially into the cavities 56 thereof, and it will be appreciated that the outer wall 15 of the side support 14' prevents the posts from passing entirely therethrough. A latch mechanism, generally designated by the numeral 58, is affixed on the exterior wall of the side support 14 adjacent the two outermost apertures 20. To retain the separator posts 48 within the cavities 56, it is simply a matter of sliding the bolt 60 of the associated latch mechanism 58 to a position extending partially across the protruding end portion 62 of the end support 22, which is notched at 64 for that purpose. The resultant relationship of the elements is best seen in FIGS. 2 and 5.

Figure 8:
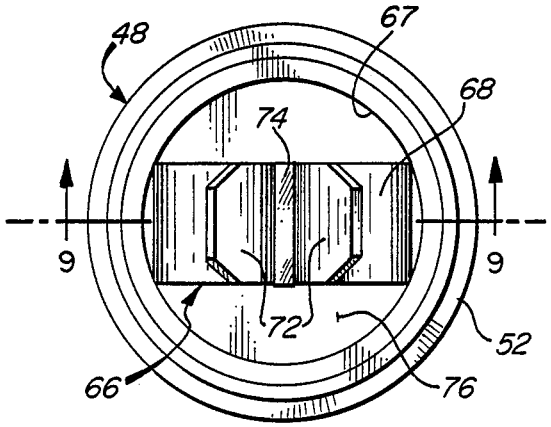
FIG. 8 is a end view of one of the separator posts, showing the sample-clamping fixture contained within the cavity thereof.
Figure 9:
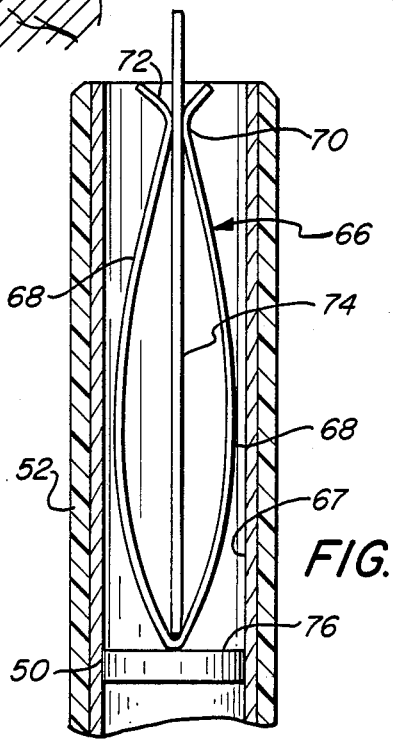
FIG. 9 is a fragmentary sectional view of the post of FIG. 8, taken along line 9—9 thereof and drawn to a reduced scale.

Turning now in detail to FIGS. 8 and 9, as can be seen therein a gripping fixture, generally designated by the numeral 66, is seated within the cavity 67 in the upper end portion of the post 48, and consists of a length of spring steel which is folded upon itself to provide a pair of bowed legs 68. The outer end portions 70 of the legs 68 normally lie in contact with one another, and have laterally deformed elements 72 which define a lead-in channel to the space between the legs 68. The fixture 66 serves to retain a short piece 74 of the material for which the skid is employed, thereby providing a readily accessible sample of the product, as is required in many instances and is conventionally taped to the skid. As will be appreciated, samples taken from the opposite ends of the coiled product may be held in each of the two separator posts. A circular plug 76 is affixed (frictionally or by other means) within the posts to define the inner limit of the cavity 67, and to prevent foreign materials from dropping into the lower regions of the post interior.

Figure 10:
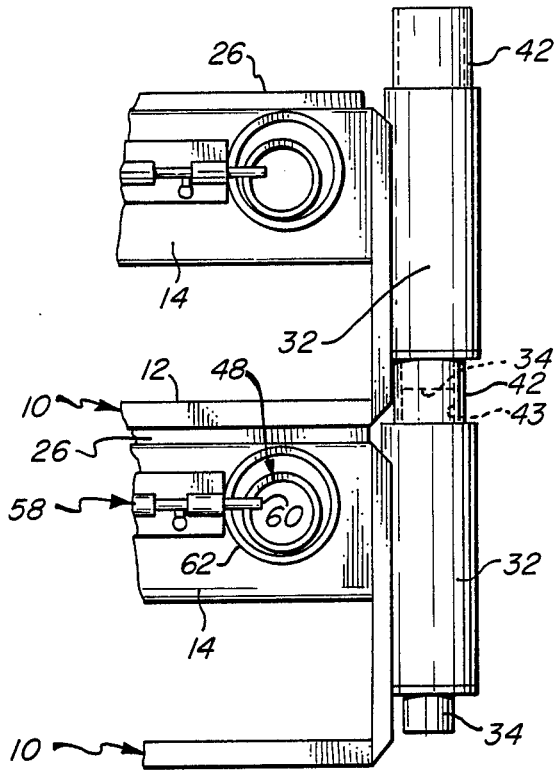
FIG. 10 is a fragmentary elevational view showing two skids of the invention nested in stacked relationship.

FIG. 10 depicts two skids of the invention stacked one upon the other, with the cylindrical protuberence 34 on the mounting assembly of the upper skid engaged within the cavity 43 of the collar 42 of the lower one. This interengagement serves of course to unify the skids and maintain them against relative lateral shifting, and thereby to improve transportability. It will be evident that a number of skids will normally be included in each stack, which will typically comprise eight or more.

Figure 6:
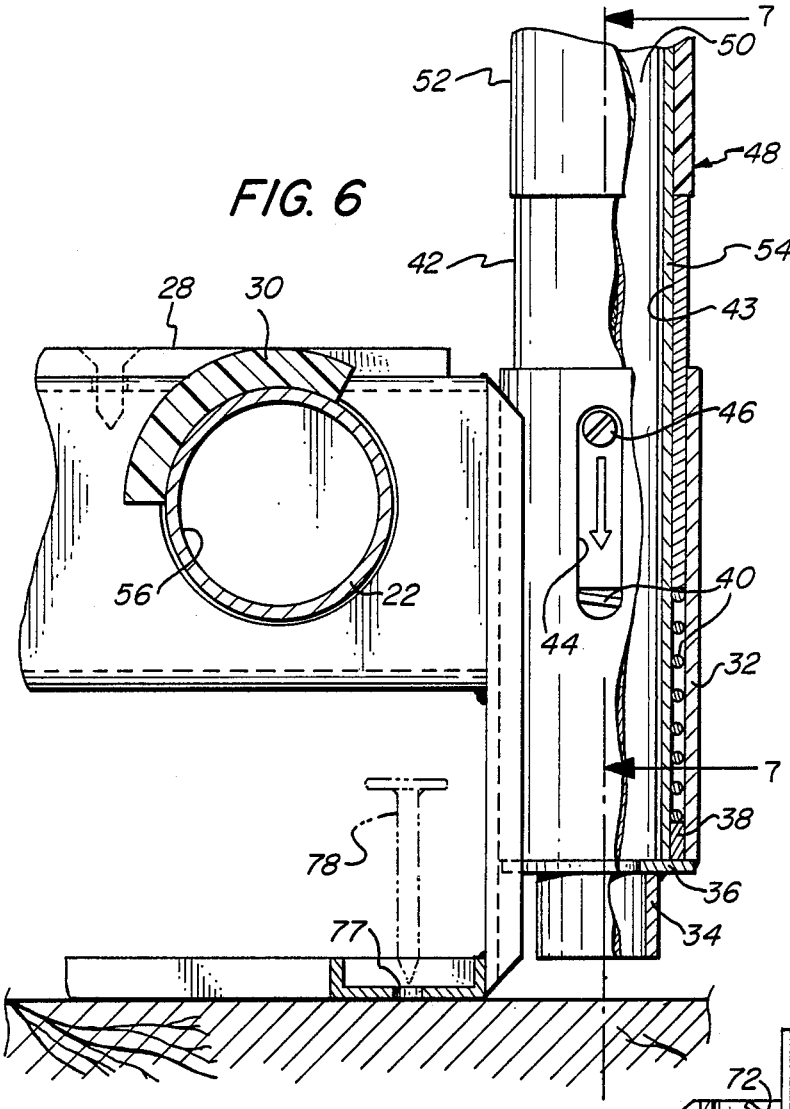
FIG. 6 is a fragmentary view taken along line 6—6 of FIG. 3, drawn to an enlarged scale and showing portions of the mounting assembly and associated separator post broken away.
Figure 7:
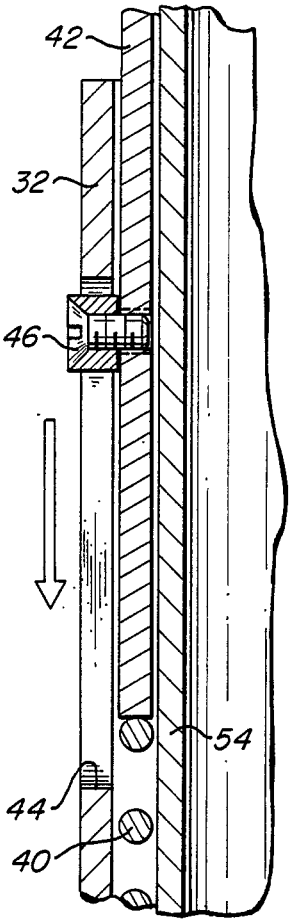
FIG. 7 is a section view along line 7—7 of FIG. 6, drawn to a further enlarged scale and showing details of the mounting assembly.

As can be seen in FIG. 6, the bar channel pieces 12 comprising the base of the skid may be formed with small holes 77 through which nails 78 or other fasteners may be inserted. In this manner, the lowermost skid of the stack can be affixed directly to the bed of a truck or other vehicle used to transport them, again in the interest of achieving maximum stability.

In FIG. 11, use of the skid to support a coil C in its horizontal attitude is illustraed. To do so, no modification from the arrangement shown in the foregoing figures need be made, other than to remove and store the separator posts 50. The collars 42 of the mounting assemblies will simply be forced into the sleeves 32 thereof, under the weight of the coil, and a strap S will of course be used to restain it against movement on the skid. Disposition of the uppermost surfaces of the protective strips 26, 28, 30 in a common plane, as has been described hereinabove, serves not only to best support the coil in horizontal position, but also to most stably support the skids in stacked relationship, The arcuate depression 24 in the side support 14 is provided to facilitate the introduction of a sling under the horizontally seated coil to enable it to be unloaded from the skid.

Thus, it can be seen that the present invention provides a novel skid for holding coiled products, which is adapted to securely maintain them in either upright or flat positions, which will effectively maintain side-by-side coils out of contact with one another, and which will provide a high degree of protection to the product. The invention also provides such a skid which does not require the use of packaging components other than banding to maintain the coils of product in place, which is capable of holding coils of differing sizes, and which is relatively light in weight for easy handling and yet sufficiently strong and durable to permit repeated use. The skid may have separator posts that can be disassembled from the base and stored therewithin for convenient return shipment, and it may also have interengaging components to enhance the security of stacking with another skid of like construction. The skid provided can be lifted from either the end or the side, and can be conveyed either sidewise or endwise.

The unique skid design provided enables the use of standard structural pieces, such as pipes, bar channel, and the like, and thus is relatively facile and inexpensive to manufacture. Fianlly, the invention provides a novel and convenient method for the loading, unloading and return of a skid for coiled products.

Having thus described the invention, what is claimed is:

1. A returnable skid for coils of products, comprising:
a frame-like, generally rectangular base with a substantially flat bottom surface;
a pair of upstanding side supports extending transversely along the opposite lateral margins of said base;
a pair of generally rectilinear end supports extending laterally across said side supports adjacent the opposite ends of said base and thereabove to define, in cooperation with said side supports, an upwardly opening recess for receiving edge portions of coils of products seated on said skid and disposed with their axes parallel to the plane of said bottom surface, each of said end supports being substantially hollow to define an elongated cavity within the interior thereof, and being open at least at one end to permit access thereto;
a pair of generally rectilinear separator posts dimensioned and configured to fit individually within said cavities of said end supports, and to permit insertion through said one ends thereof;
means for disengageably mounting one of said posts in an upstanding attitude adjacent each of said opposite ends of said base and between said side supports; and
means for disengageably securing said posts within said cavities, whereby said posts may be supported by said mounting means to extend between two coils so seated on said skid, and may be stored within said cavities when not in use.

2. The skid of claim 1 additionally including a center support extending transversely of said base between said side supports and having opposite ends adjacent said opposite ends of said base, said side and center supports being rectilinear and parallel, and said mounting means for said posts being disposed on said opposite ends of said center support.

3. The skid of claim 1 wherein said end supports comprise tubular members, and wherein said side supports are provided with apertures in which said tubular members are engaged.

4. The skid of claim 3 wherein one of said side supports has portions overlying and closing one end of each of said tubular members, said securing means being disposed on the other of said side supports and being displaceable between positions for securing said posts within said cavities and for permitting insertion thereinto and withdrawal therefrom.

5. The skid of claim 4 wherein said securing means comprises a pair of latches, each latch having an element that is selectively positionable across the other end of the associated tubular member.

6. The skid of claim 1 wherein said side supports and said end supports all have top surfaces lying in a common plane.

7. The skid of claim 6 wherein said side and end supports have separate elements thereon providing said top surfaces, said elements being fabricated from a relatively hard and durable synthetic resinous material.

8. The skid of claim 1 wherein said mounting means comprises an assembly adjacent each of said opposite ends of said said base, including a fixed, downwardly extending element having a lower end disposed at a level short of the plane of said bottom surface of said base, and a resiliently supported, upwardly extending element having an upper end biased to a normal position elevated above the plane in which the uppermost of the top surfaces of said side and end supports are disposed, and displaceable to a level thereon or therebelow, said downwardly and upwardly extending elements of said assemblies being configured for interengagement so as to adapt said skid for interengaged stacking with a skid of like construction, said upwardly extending elements being adapted for mounting of said posts, and said skid being adapted to support a coil of product lying horizontally on said uppermost top surfaces with said upwardly extending elements displaced downwardly, as necessary, 9. The skid of claim 8 wherein each of said assemblies comprises a normally vertically oriented sleeve, a protuberance on the lower end of said sleeve and providing said downardly extending element, a coupling piece slidably mounted by said sleeve for movement along the axis thereof and providing said upwardly extending element, and means biasing said coupling piece toward said elevated position of said upper end, said coupling piece being adapted to interengage with both said protuberance and also an end portion of one of said posts.

10. The skid of claim 9 wherein said coupling piece is a collar having a cavity extending inwardly from said upper end thereof along the axis of said sleeve, said protuberance of said mounting assembly and said end portion of said post both being configured to fit within said cavity of said collar.

11. The skid of claim 1 wherein at least one of said separator posts has a cavity extending inwardly from one end thereof, and includes a clamping fixture disposed therewithin, said fixture being adapted to receive and retain a piece of the product of which the coil seated on said skid is comprised.

12. The skid of claim 11 wherein said fixture comprises a pair or resiliently deflectable legs having outer end portions disposed at the entrance to said cavity of said post and normally in contact with one another, said legs being adapted to frictionally engage a piece of product inserted between them.

13. A returnable skid for coils of products, comprising:
a frame-like, generally rectangular base with a substantially flat bottom surface;
a pair of upstanding side supports extending transversely along the opposite lateral margins of said base;
a pair of generally rectilinear end supports extending laterally across said side supports adjacent the opposite ends of said base and thereabove to define, in cooperation with said side supports, an upwardly opening recess for receiving edge portions of coils of products seated on said skid;
separator means; and
means for disengageably mounted said separator means in an upstanding attitude adjacent said opposite ends of said base and between said side supports, said mounting means comprising an assembly adjacent each of said opposite ends of said base, including a fixed, downwardly extending element having a lower end disposed at a level short of the plane of said bottom surface of said base, and a resiliently supported, upwardly extending element having an upper end biased to a normal position elevated above the plane in which the uppermost of the top surfaces of said side and end supports are disposed, and displaceable to a level thereon or therebelow, said downwardly and upwardly extending elements of said assemblies being configured for interengagement so as to adapt said skid for interengaged stacking with a skid of like construction, said upwardly extending elements being adapted for mounting of said separator means, and said skid being adapted to support a coil of product lying horizontally on said uppermost top surfaces with said upwardly extending elements displaced downwardly, as necessary.

14. The skid of claim 13 wherein each of said assemblies comprises a normally vertically oriented sleeve, a protuberance attached to the lower end of said sleeve and providing said downwardly extending element, a coupling piece slidably mounted by said sleeve for movement along the axis thereof and providing said upwardly extending element, and means biasing said coupling piece toward said elevated position of said upper end, said coupling piece being adapted to interengage with both said protuberance and also an end portion of said separator means.

15. The skid of claim 14 wherein said coupling piece is a collar having a cavity extending inwardly from said upper end thereof along the axis of said sleeve, said protuberance of said mounting assembly and said end portion of said separator means both being configured to fit within said cavity of said collar.

16. In a method for carrying out the shipment of products in coiled form on a reusable skid, the steps including:

(a) providing a skid for coils of products, comprising:

a frame-like, generally rectangular base with a substantially flat bottom surface;

a pair of upstanding side supports extending transversely along the opposite lateral margins of said base;

a pair of generally rectilinear end supports extending laterally across said side supports adjacent the opposite ends of said base and thereabove to define, in cooperation with said side supports, an upwardly opening recess for receiving edge portions of coils of products seated on said skid and disposed with their axes parallel to the plane of said bottom surface, each of said end supports being substantially hollow to define an elongated cavity within the interior thereof, and being open at least at one end to permit access thereto;

a pair of generally rectilinear separator posts dimensioned and configured to fit individually within said cavities of said end supports, and to permit insertion through said one ends thereof;

means for disengageably mounting one of said posts in an upstanding attitude adjacent each of said opposite ends of said base and between said side supports; and means for disengageably securing said posts within said cavities;

(b) loading two coils of product on said skid in side-by-side, laterally spaced positions, with the axes thereof disposed parallel to the plane of said bottom surface and with edge portions of said coils received within said upwardly opening recess;

(c) strapping said coils to the skid;

(d) engaging said posts in said mounting means in an upstanding attitude adjacent said opposite ends of said base to extend between said coils;

(e) transporting said skid with said coils loaded thereon;

(f) unstrapping said coils and unloading them from said skid;

(g) disengaging said posts from said mounting means;

(h) inserting said posts into said cavities, and securing them therewithin; and (i) transporting said unloaded skid with said posts so stored.

17. The method of claim 16, wherein said mounting means of said skid comprise an assembly adjacent each of said opposite ends of said base, including a fixed, downwardly extending element having a lower end disposed at a level short of the plane of said bottom surface of said base, and a resiliently supported, upwardly extending element having an upper end biased to a normal position elevated above the plane in which the uppermost of the top surfaces of said side and end supports are disposed, and displaceable to a level thereon or therebelow, said downwardly and upwardly extending elements of said assemblies being configured for interengagement so as to adapt said skid for interengaged stacking with a skid of like construction; and wherein said method additionally includes the step, effected prior to said transporting step (i), of:

(j) superimposing said skid upon a second skid, and interengaging said downwardly extending elements of said assemblies with the upwardly extending elements of the assemblies of said second skid.

* * * * *